US010117023B2

(12) United States Patent
Harvey

(10) Patent No.: US 10,117,023 B2
(45) **Date of Patent: *Oct. 30, 2018**

(54) AUDIO ENHANCEMENT

(71) Applicant: Cirrus Logic International Semiconductor Ltd., Edinburgh (GB)

(72) Inventor: Thomas Ivan Harvey, Northcote (AU)

(73) Assignee: Cirrus Logic, Inc., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/661,594

(22) Filed: Jul. 27, 2017

(65) Prior Publication Data

US 2017/0325029 A1 Nov. 9, 2017

Related U.S. Application Data

(63) Continuation of application No. 15/191,769, filed on Jun. 24, 2016, now Pat. No. 9,749,749.

(60) Provisional application No. 62/184,974, filed on Jun. 26, 2015.

(51) Int. Cl.

| | |
|---|---|
| ***H04R 3/04*** | (2006.01) |
| ***H04R 5/02*** | (2006.01) |
| ***H04R 5/04*** | (2006.01) |

(52) U.S. Cl.

CPC ..... *H04R 5/04* (2013.01); *H04R 3/04* (2013.01); *H04R 5/02* (2013.01); *H04R 2430/01* (2013.01); *H04R 2499/11* (2013.01)

(58) Field of Classification Search

CPC ..... H04R 5/04; H04R 5/02; H04R 2430/01; H04R 3/04; H04R 2499/11

See application file for complete search history.

(56) References Cited

U.S. PATENT DOCUMENTS

| | | | |
|---|---|---|---|
| 7,483,543 | B2 | 1/2009 | Cranfill et al. |
| 8,094,845 | B2 | 1/2012 | Douhet et al. |
| 8,295,498 | B2 | 10/2012 | Karlsson et al. |
| 8,306,231 | B2 | 11/2012 | Gustavsson et al. |
| 8,699,963 | B2 | 4/2014 | Chen et al. |
| 2002/0042287 | A1 | 4/2002 | Asami |
| 2002/0137478 | A1 | 9/2002 | Masamura |
| 2015/0011264 | A1 | 1/2015 | Macours |

FOREIGN PATENT DOCUMENTS

| | | |
|---|---|---|
| EP | 2281399 | 10/2009 |
| EP | 2248352 B1 | 1/2013 |

OTHER PUBLICATIONS

Combined Search and Examination Report under Sections 17 and 18(3), Application No. GB1611051.2, dated Nov. 16, 2016, 5 pages.

*Primary Examiner* — Brenda C Bernardi

(74) *Attorney, Agent, or Firm* — Jackson Walker L.L.P.

(57) ABSTRACT

A signal processing module is configured to receive left and right channels of stereo input audio data and generate first and second channels of output audio data for first and second loudspeakers where the first and second loudspeakers have different frequency responses to one another. The signal processing module comprises an impulse emphasis block configured to emphasize impulsive sounds in the received audio in at least one of the first and second channels of output audio data.

17 Claims, 5 Drawing Sheets

AUDIO ENHANCEMENT

This application is a continuation of U.S. Non-Provisional application Ser. No. 15/191,769 filed on Jun. 24, 2016, which claims priority to U.S. Provisional Application No. 62/184,974 filed on Jun. 26, 2015, both of which are incorporated by reference herein in their entirety.

FIELD OF DISCLOSURE

The field of representative embodiments of this disclosure relates to methods, apparatuses, and/or implementations concerning and/or relating to stereo enhancement, in particular to stereo enhancement techniques for closely-spaced speakers and in particular for closely-spaced with a mismatched frequency response.

BACKGROUND

Most modern communication devices, especially portable communications devices such mobile or cellular telephones, comprise at least two speakers. Typically for instance there may be a first loudspeaker located on the device, e.g. for audio media playback. This first loudspeaker may for example be located towards the bottom of the device. In addition there is typically also an earpiece receiver loudspeaker (i.e. a second speaker) at a different location on the device, typically towards the top of the device or otherwise at a location near where a user's ear may be expected to be in use (if not using an accessory such as a headset or using the device in a speakerphone type mode).

FIG. 1 for example illustrates a device 100, which in this example may be a mobile telephone, having a side ported first loudspeaker 102 at a first location on the device and also having an earpiece receiver speaker 104 at a different location.

In most common configurations the earpiece speaker and first loudspeaker are used for different functions and typically the first loudspeaker can generate a much greater sound pressure level (SPL) than the earpiece. The earpiece receiver speaker (which will be referred to herein simply as an earpiece or earpiece speaker) is typically used as the output device during handset calls (without an attached peripheral device such as a headset), when it is expected that the device is held next to the user's ear. The first loudspeaker may be used as the the output device during music playback and speaker phone mode calls.

The first loudspeaker may therefore typically be of the order of 8 Ohm, and may be driven for example by a 5V-10V boosted D or G class amp which is capable of driving around 4 W in to the speaker. The earpiece may typically be of the order of 32 Ohm, and may for example be driven by a 2.5V A/B class amp which is capable of driving around 100 mW in to the earpiece speaker.

SUMMARY

Embodiments of the invention relate to methods and apparatus for generating multi-channel audio, in particular a stereo audio experience for the user, by using both the earpiece receiver speaker and the first loudspeaker simultaneously. In other words embodiments relate to methods and apparatus for driving first and second loudspeakers of an apparatus such as a mobile communication device, e.g. a mobile telephone, with stereo audio where the first and second loudspeakers have an unmatched or mismatched frequency response.

Embodiments of the present invention relate to a signal processing module for receiving left and right channels of stereo input audio data and generating first and second channels of output audio data for first and second loudspeakers where the first and second loudspeakers have different frequency responses to one another. In some embodiments the first and second channels of output audio data may be for first and second speakers which are physically separated by less than 15 cm or less than 10 cm.

In one embodiment the signal processing module comprises an impulse emphasis block configured to emphasise impulsive sounds in the received audio in at least one of the first and second channels of output audio data.

In one embodiment an impulse emphasis block is configured to emphasise impulsive sounds in both said first and second channels of output audio data.

The impulse emphasis block may comprise an impulse detection function and an impulse enhancement function that is configured to enhance the effect of impulsive sounds.

The impulse emphasis block may comprise a limiter with fast attack. The limiter with a fast attack may have the effect of creating short lived distortion during high level audio peaks.

The impulse emphasis block may comprise a limiter having an attack time that is configured to generate distortion during audio peaks.

In one embodiment the signal processing module is operable in a first mode in which the left and right channels of stereo input audio data are divided into a first and second high frequency signals and a combined low frequency signal, wherein the first high frequency signal correspond to components of one of the left and right channels of stereo input audio data above a first cut-off frequency, the second high frequency signal correspond to components of the other one of the left and right channels of stereo input audio data above the first cut-off frequency and the combined low frequency signal corresponds to combined components of the left and right channels of stereo input audio data below the first cut-off frequency.

The impulse emphasis block may be configured to act on the first and second high frequency signals. In some embodiments a signal widening block may be configured to widen the first and/or second high frequency signals. The signal widening block may be located in a signal path upstream of the impulse emphasis block. In some embodiments a phase shift or delay block may be arranged in a signal path for one of the first or second high frequency signals. The delay block may be arranged in the signal path downstream of the impulse emphasis block.

The first high frequency signal, after any widening, impulse emphasis and/or delay, may be combined with the combined low frequency signal to provide the first channel output audio data. The first loudspeaker may be a loudspeaker of a device used for media playback.

The second high frequency signal, after any widening, impulse emphasis and/or delay, may be used as the second channel output audio data. The second loudspeaker may be an earpiece receiver speaker.

In some embodiments a controllable low pass filter may be located in a signal path for the first high frequency signal, wherein the controllable low pass filter may be selectively operated to filter the second high frequency signal below a second cut-off frequency. The second cut-off frequency may be higher than the first cut-off frequency. In the first mode of operation the controllable low pass filter may be controlled to apply no filtering. The signal processing module may be operable in a second mode in which the controllable low pass filter is operated to apply filtering. In the second mode of operation a switching rate or switching speed of an amplifier arranged to receive the first channel of audio data may be lower than in the first mode of operation.

In one embodiment the signal processing module is operable in a third mode in which the left and right channels of stereo input audio data are divided into a combined high frequency signal and a combined low frequency signal, wherein the combined high frequency signal corresponds to combined components of the left and right channels of stereo input audio data above a third cut-off frequency and the combined low frequency signal corresponds to combined components of the left and right channels of stereo input audio data below the third cut-off frequency.

In some embodiments the signal processing module may be selectively operable in the first mode or the third mode. The third cut-off frequency may be the same as or higher than the first cut-off frequency.

In the third mode an impulse emphasis block may be configured to receive the combined high frequency signal and the combined low frequency signal and emphasis impulsive sounds in said signals.

A delay block may be configured to operate on one of the combined high frequency signal or the combined low frequency signal after impulse emphasis. The combined low frequency signal after impulse emphasis and any delay may provide the first channel output audio data. The first loudspeaker may be a loudspeaker of a device used for media playback. The combined high frequency signal, after any impulse emphasis and/or delay, may be used as the second channel output audio data. The second loudspeaker may be an earpiece receiver speaker.

In the third mode of operation a switching rate or switching speed of an amplifier arranged to receive the first channel of audio data may be lower than in the first mode of operation.

Embodiments of the invention relate to a portable electronic device comprising a signal processing module in accordance with other embodiments, wherein the first loudspeaker is a loudspeaker of the device suitable for media playback and the second loudspeaker of the device is an earpiece loudspeaker.

When the signal processing module is selectively operable in the first mode or the third mode of operation, the device may be configured such that a switching frequency of an amplifier driving the first loudspeaker is lower in the third mode of operation than in the first mode of operation.

Embodiments relate to an audio signal processing module configured to receive first and second input signals corresponding to stereo audio data and to process said first and second input signals to generate first and second channels of output audio data, in which the module comprises: a filter block configured such that, in a first mode of operation: the first channel of output audio data corresponds to the first input signal and components of the second input signal below a first cut-off frequency and the second channel of output data corresponds to components of the second input signal above the first cut-off frequency. The module may also comprise an impulse emphasis block configured to emphasise impulsive sounds in at least one of the first and second channels of audio output data.

Embodiments relate to an audio signal processing module for processing an input stereo audio signal into an output stereo signal suitable for frequency mismatched speakers of a portable electronic device, the module comprising an impulse emphasis block for emphasising impulsive sounds in the output stereo signal.

The module may comprise a filter block configured such that one channel of the output stereo signal comprises a combined low frequency signal, the combined low frequency signal corresponding to components of both channels of input stereo data below a cut-off frequency.

Embodiments relate to an electronic device comprising: a first loudspeaker having a first power and frequency range; a second loudspeaker having a second power and frequency range which is different to the first power and frequency range; and a signal processing module configure to receive an input stereo audio signal and generate output stereo data for said first and second loudspeakers. The signal processing module may be configured to emphasise impulsive sounds present in the input stereo data in said output stereo data.

Embodiments relate to a signal processing module configured to receive first and second channels of stereo input audio data and generate first and second channels of output audio data for first and second loudspeakers where the first and second loudspeakers have different frequency responses to one another, wherein the signal processing module comprises a filter block operable in first and second modes. In the first mode, the first channel of output audio data may comprise a combined low frequency signal and a first high frequency signal, the combined low frequency signal corresponding to audio components of both the first and second channels of stereo input audio data below a first cut-off frequency and the first high frequency signal corresponding to audio components of the first channel of stereo input audio data above a second cut-off frequency; and the second channel of output audio data comprises a second high frequency signal, the second high frequency signal corresponding to audio components of the second channel of stereo input audio data above a second cut-off frequency. In the second mode, the first channel of output audio data may comprise the combined low frequency signal; and the second channel of output audio data comprises a combined high frequency signal, the combined high frequency signal corresponding to audio components of both the first and second channels of stereo input audio data above a third cut-off frequency.

Embodiments relate to an electronic device comprising: first and second loudspeakers, with the first loudspeaker having a higher power rating and a greater response at lower frequencies than the second loudspeaker; a switching amplifier for driving said first loudspeaker; and a signal processing module configured to receive an input audio signal and generate first and second output audio channels for said first and second loudspeakers respectively. The signal processing module may be operable in a first mode and a second mode, wherein in the second mode the first output audio channel is limited so as to only comprise components of the input audio data below a cut-off frequency and in the first mode the first output audio channel may comprise at least some components of the input audio data above the cut-off frequency. A switching frequency of the switching amplifier may be greater in the first mode than in the second mode.

BRIEF DESCRIPTION OF THE DRAWINGS

The invention will now be described, by way of example only with reference to the accompanying drawings, of which.

DETAILED DESCRIPTION

As mentioned embodiments of the invention relate to methods and apparatus for stereo audio that uses two loudspeakers of the mobile device, in particular the earpiece used for audio output during handset calls and a device loudspeaker typically used for media playback. The two loudspeakers may be relatively closely spaced to one another, e.g. within 15 cm or within 10 cm for example. Additionally or alternatively the two loudspeakers may be unmatched.

The two loudspeakers may be unmatched in that they can generate significantly different sound pressure levels (SPLs) and/or in that they have a mismatched or unmatched frequency response.

Generating stereo audio using two such loudspeakers on a device such as a mobile represents various challenges.

One challenge is insufficient speaker separation. The first loudspeaker and the earpiece are typically closely spaced to one another, for example typically of the order of 10 cm-15 cm, and thus are too close to each other to recreate the stereo effect of a conventional speaker arrangement. It will be appreciated that stereo audio data will have been produced or mastered as a stereo track based on a conventional speaker arrangement which will have assumed a greater speaker separation.

As will be understood by one skilled in the art, the perceived location of, i.e. the origin of, a given sound will (amongst other factors) depend on the time difference of arrival (TDOA) between each ear. In a conventional stereo speaker arrangement the TDOA for the left speaker ($TDOA_L=t_{SLEL}-t_{SLER}$) and for the right speaker ($TDOA_R=t_{SREL}-t_{SRER}$) differ significantly. However given the relatively small separation between the first loudspeaker and the earpiece discussed above, were such speakers used as left and right speakers respectively the TDOA for the left speaker ($t_{SLEL}-t_{SLER}$) and for the right speaker ($t_{SREL}-t_{SRER}$) would be similar and close to zero.

Another challenge is the unmatched frequency response of the two speakers, the frequency response of the earpiece and first loudspeaker differ significantly. The first loudspeaker is typically more sensitive, and will typically have a larger back cavity volume and be driven by a higher drive voltage compared to the smaller earpiece. The first loudspeaker is sometimes not ported to the front of the device, e.g. the mobile phone, and may instead by side ported. For a user who is looking at the front of the device, e.g. the screen this side porting may result in significant high frequency (HF) roll off.

The combined effect is that for low frequencies (say <1 kHz) the first loudspeaker has significantly greater response than the earpiece whereas at higher frequencies (say >4 Khz) the earpiece may dominate over the first loudspeaker.

Figure 1:
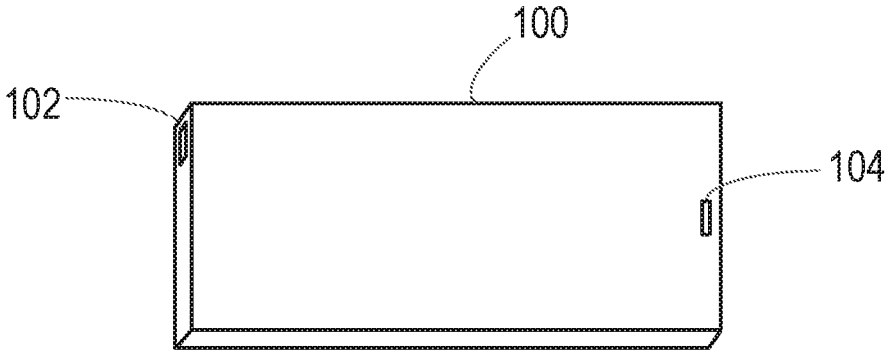
FIG. 1 illustrates a conventional mobile communication device.
Figure 2B:
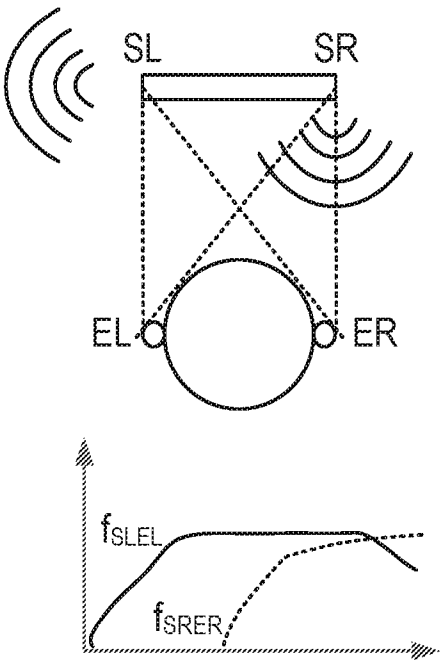
FIGS. 2(*a*) and 2(*b*) illustrate the difference between using a conventional speaker arrangement and using two speakers of a mobile device for stereo.
Figure 2A:
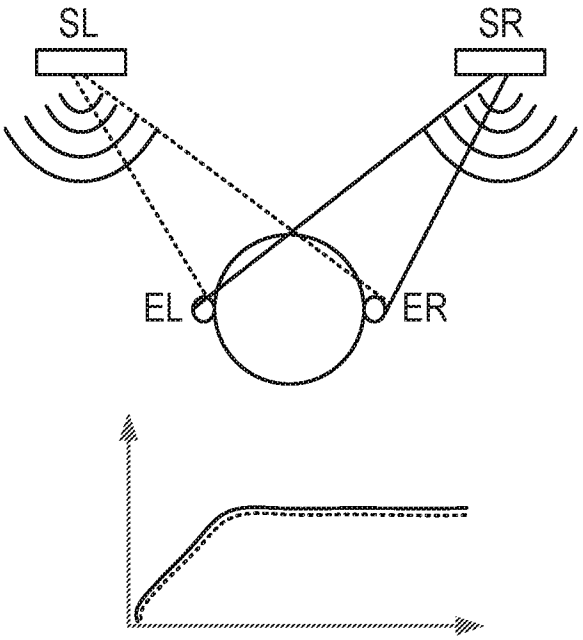

FIG. 2(*a*) illustrates a conventional stereo speaker arrangement showing the arrangement of the left speaker SL and right speaker SR and how sound is transmitted to the left ear EL and right ear EL of a user. The time differences of arrival are significant, that is $TDOA_L \ll 0 \ll TDOA_R$. Also shown are the frequency responses $f_{SLEL}$ and $f_{SRER}$ of the two speakers which are matched, that is $f_{SLEL}=f_{SRER}$.

FIG. 2(*b*) illustrates how stereo may be implemented using the first loudspeaker (which is side ported in this example) as the left speaker SL and the earpiece as the right speaker SR. This figure illustrates that the time difference of arrival between the signals from left and right speakers is much lower and near zero, i.e. $TDOA_L \approx 0 \approx TDOA_R$. Also illustrated are the different frequency responses $f_{SLEL}$ and $f_{SRER}$ of the two speakers that are not matched, that is $f_{SLEL} \neq f_{SRER}$.

It will also be noted that driving both the first loudspeaker and earpiece will increase power consumption, with a consequent reduction in battery life.

In one embodiment therefore, to create the desired stereo effect, the audio data is processed using an algorithm, for instance a DSP (digital signal processing) algorithm is used to overcome the effects of poor speaker separation and unmatched frequency response. The algorithm may at the same time reduce or minimise power consumption.

Embodiments therefore relate to signal processing modules for processing audio data. Embodiments also relate to methods of processing audio data.

Embodiments take advantage of the following psychoacoustic principals:

- Impulsive sounds are more easily located than stationary sounds;
- Stereo cues are dominant at mid frequencies (where both speaker and receiver can be driven); and
- The presence of distortion can be difficult to perceive if the distortion is short in duration (a few milliseconds) and coincident with existing signal peaks.

Figure 3:
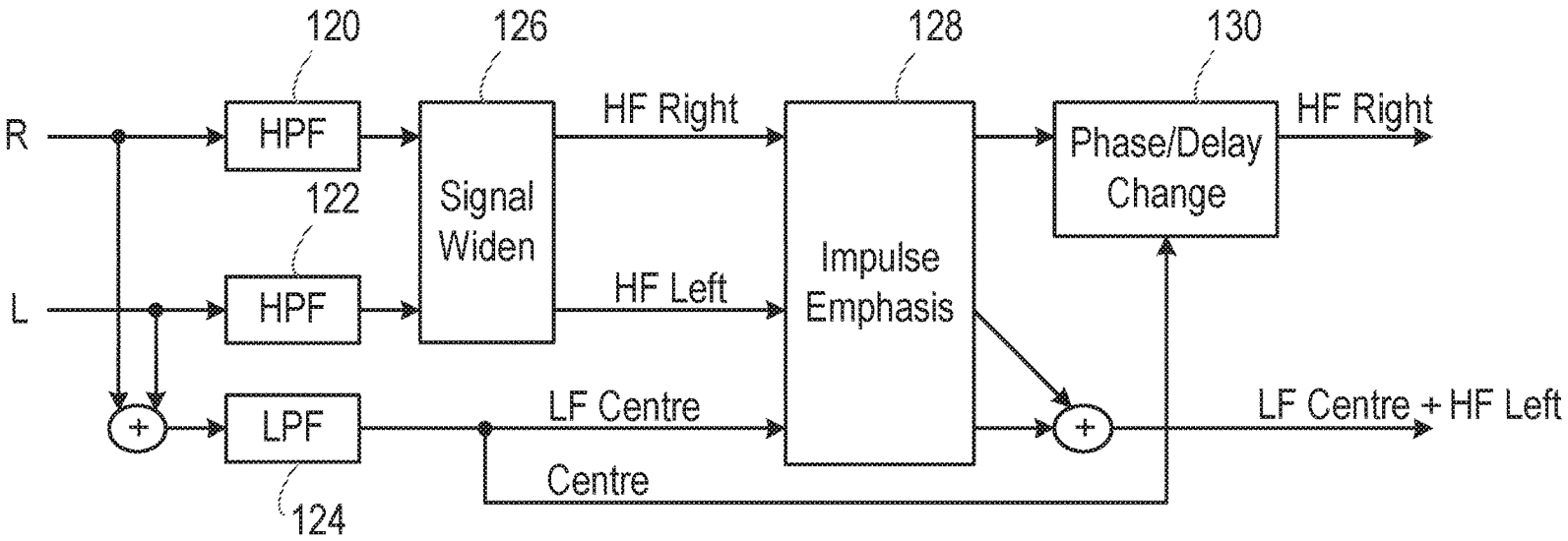
FIG. 3 illustrates a first mode of operation according to an embodiment.

FIG. 3 illustrates one example of how left and right stereo audio data may be processed in one operating mode of an embodiment, which may be referred to as a high output mode. FIG. 3 illustrates the functional units or blocks of a signal processing module according to an embodiment of the invention.

Note that as used herein the term 'block' shall be used to refer to a functional unit or module which may be implemented at least partly by dedicated hardware components such as custom defined circuitry and/or at least partly be implemented by one or more software processors or appropriate code running on a suitable general purpose processor or the like. A block may itself comprise other blocks or functional units.

FIG. 3 illustrates that the left and right audio data may be mapped into a low frequency channel (below a cut-off frequency) and into left and right high frequency channels (above the cut-off frequency). The cut-off frequency for high- and low-frequency may vary for a particular device but may, for example, be of the order of 700 Hz or so.

FIG. 3 illustrates that the right and left channels are input to respective high pass filters (HPF) 120, 122 to generate the respective high frequency channels and that the left and right channels are combined before being input to a low pass filter (LPF) 124 to generate the low frequency channel but other arrangements of filters may be used.

In some embodiments the high frequencies, i.e. the left and right high frequency channels, are widened (by a signal widen block 126). For example the left channel high frequency data, L, and right channel high frequency data, R, may be widened according to:

$$L=L+wf(L-R)$$

$$R=R+wf(R-L)$$

where wf is a widening factor which may, for example by in the range $0<wf<0.5$.

The processing may then emphasise any impulsive sounds in the audio data. The aim is to emphasise the sound in each high frequency channel in the presence of impulsive sounds such as kick drum, rim shots, etc. An impulse emphasis block 128 may then be arranged to emphasise the impulsive sounds. In one example this may be achieved by using a limiter with fast attack that has the effect of creating short lived distortion during high level audio peaks. The input signal to the limiter could, for instance, be the LF audio data (which may be seen as effectively a centre channel) with gain applied to the high frequency channels. Alternatively the limiter could use the full band signal with some pre-emphasis, e.g. for the low frequency channel.

To emphasise the stereo effect, a delay can be added to one of the left or right channels, i.e. the left high frequency channel or right high frequency channel, by a phase/delay block. FIG. 3 illustrates a phase/delay change block 130 applying a delay to the right channel but a delay could equally be applied to the left channel instead.

In some embodiments which of the channels the delay is added to may depend on which channel corresponds to the first loudspeaker and which channel corresponds to the earpiece.

In some embodiments the allocation of the left and right audio channels to the first loudspeaker or earpiece may be fixed. For example FIG. 2 shows the first loudspeaker used for the left channel and the earpiece used for the right channel. This may be preset such that the earpiece is always used for the right channel and the first loudspeaker for the left channel (or vice versa). For playback of audio data which accompanies a video track the playback of the video on the screen of the device may be constrained so as to match the particular orientation, i.e. so that in order to view the video in the correct orientation the user must hold the device with the first loudspeaker on the left for instance. For playback of audio without accompanying video in some instance the device may be configured to display an indication of the correct orientation or it may be decided that without accompanying video having the correct orientation does not matter—it is the stereo effect itself that is desired.

In some embodiments however the device may be arranged to determine the current orientation of the device when being used for stereo playback and to allocate the left and right channels to the earpiece and first loudspeaker accordingly.

FIG. 3 illustrates the example where the first loudspeaker is being used for the left channel and earpiece is being used for the right loudspeaker as illustrated in FIG. 2.

In this case therefore it may be desirable to delay the left channel, instead of the right channel, to spread the LF/HF energy in the left channel so that the peak voltage & speaker excursion can be reduced such that a higher average SPL achieved.

To avoid adding too much perceived reverb, the phase delay could be actively introduced when the signal level is high (i.e. the impulse emphasis is active). In other words the delay may be applied or not and/or the amount of delay may be variable depending on the signal level.

After any delay has been applied the low frequency centre data may be combined with the relevant channel for the first loudspeaker, in the example of FIG. 3 the left channel. The combined low frequency data and one channel, in this case the left channel, of high frequency data may be supplied to the first loudspeaker and the other channel of high frequency data supplied to the earpiece.

The result is that any impulsive sounds in the audio, which lead to a greater perceived stereo effect are emphasised. The two speakers are used for stereo channels in the mid frequency range where the stereo cues are most effective. In addition a delay between the high frequency channels may be added to emphasis the stereo effect.

This has the result of increasing the perceived stereo even when using mismatched and/or closely spaced speakers as the left and right speakers.

Figure 4:
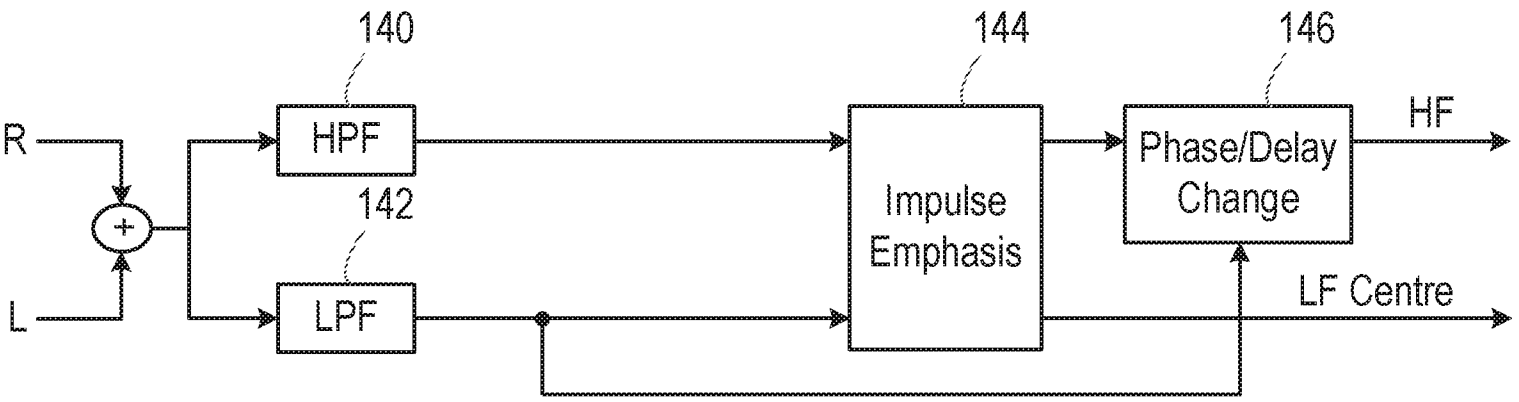
FIG. 4 illustrates a second mode of operation according to an embodiment.

As mentioned previously driving both the first loudspeaker and earpiece simultaneously does increase power consumption compared to using just the first loudspeaker say. FIG. 4 illustrates an example how left and right stereo audio data may be processed in another operating mode of an embodiment, which may be referred to as a power save mode, that is a lower power mode than that illustrated in FIG. 3. FIG. 4 thus illustrates a signal processing module according to another embodiment.

In the mode illustrated in FIG. 4 the left and right audio channels are combined, into effectively a mono channel audio signal, before being divided into high frequency and low frequency channels by suitable filters 140, 142.

Again any impulsive sounds are emphasised, e.g. by an impulse emphasis block 144, and an optional delay may be added to one of the channels by a phase/delay change block 146. The low frequency channel is then used to drive the first loudspeaker with the high frequency channel being used to drive the earpiece.

In this embodiment the frequency range of the first loudspeaker may thus be limited as the first loudspeaker receives only the low frequency data. Therefore the amplifier for the first loudspeaker speaker may be switched at a lower frequency, thus providing power saving.

In this instance the underlying audio signal is effectively mono but because some high frequency content is played on the earpiece, optionally with impulsive sounds emphasised and possibly with a delay added, a stereo effect is perceived by the user.

The cut-off frequency may again be of the order of 700 Hz or so but in this mode it may be beneficial to use a higher cut-off frequency, for instance a frequency greater than 700 Hz but lower than say 4 kHz for example.

In some embodiments a signal processing module may be configured to selectively operate in the mode illustrated with respect to FIG. 3 or in the mode illustrated with respect to FIG. 4. In some embodiments the mode of operation may be selected in use.

For instance the lower power mode illustrated with respect to FIG. 4 may be a default mode, with higher power mode of FIG. 3 being offered as a discrete user controlled boost mode.

In some embodiments operation in the higher power mode of FIG. 3 could be controlled by a user setting, such as the volume control. For example a volume setting below a threshold could result in operation of the lower power mode or FIG. 4 whereas a volume setting at or above the threshold could result in operation in the higher power mode of FIG. 3.

In some embodiments the mode of operation may be automatically controlled based on the level of the input signal with the lower power mode being selected if the input signal is below a certain level.

The mode could also be selected based on an indication of power level, e.g. battery voltage.

Figure 5:
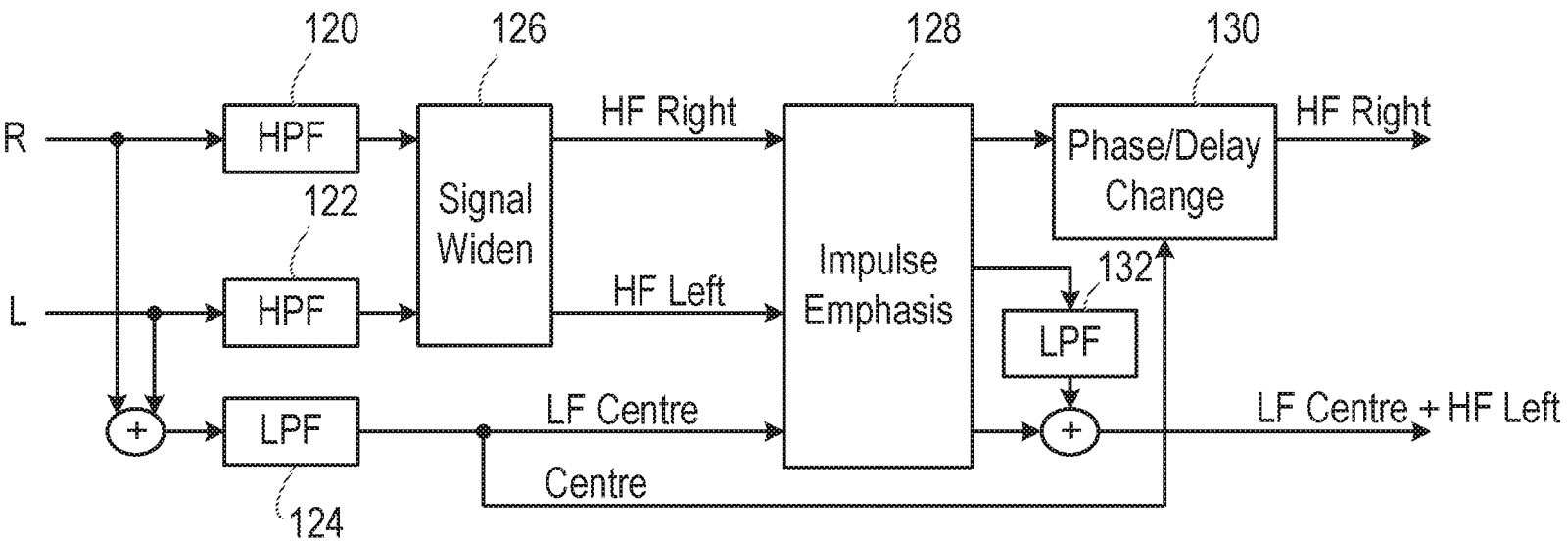
FIG. 5 illustrates a third mode of operation according to an embodiment.

FIG. 5 illustrates the principle of a signal processing module according to a further embodiment which can operate in the mode described with respect to FIG. 3 or in a lower power mode and which uses largely the same signal paths in each mode.

FIG. 5 illustrates an embodiment similar to that illustrated in FIG. 3 but with the addition of a low pass filter 132 acting on the output of the impulse emphasis block 128 for the high frequency data to be supplied to the first loudspeaker. This additional low pass filter 132 may be operated in a power save mode to provide a steep cut-off to limit the frequency range of the signal supplied to the first loudspeaker in the power saving mode, thus again reducing the power requirements for the amplifier driving the first loudspeaker.

FIGS. 3 and 5 each show an impulse emphasis block 128, while FIG. 4 shows an impulse emphasis block 144. In some embodiments, the impulse emphasis block comprises an impulse detection function and an impulse enhancement function that is configured to enhance the effect of impulsive sounds.

Impulse detection can be achieved by many means, for example by looking for a fast rate of attack in the input signal. This can be done using a differentiator, or any other high pass filter. The power output from the differentiator or other high pass filter is compared to a background level, and the result is used to detect the onset of an impulse.

Impulse emphasis can be achieved by many means, for example by increasing the signal gain in the high frequency region during the period of the impulse.

The impulse detection and impulse emphasis functions could be combined by using a limiter feed with a high-pass filtered version of the input signal (as shown in FIGS. 3, 4 and 5) and configured with fast time constants. As an alternative, spitting the process into a detector (with bassline tracking) and separate emphasis may be more robust to different source levels and music types.

FIGS. 3, 4 and 5 show embodiments in which an impulse emphasis block is configured to emphasise impulsive sounds in the received audio in the left and right channels of output audio data, but it is equally possible to emphasise impulsive sounds in the received audio in only one of these channels of output audio data.

Some embodiments relate to an audio signal processing module configured to receive first and second input signals corresponding to stereo audio data and to process said first and second input signals to generate first and second channels of output audio data, the module comprising: a filter block configured such that, in a first mode of operation: the first channel of output audio data corresponds to the first input signal and components of the second input signal below a first cut-off frequency and the second channel of output data corresponds to components of the second input signal above the first cut-off frequency; and an impulse emphasis block configured to emphasise impulsive sounds in at least one of the first and second channels of audio output data.

Some embodiments relate to an audio signal processing module for processing an input stereo audio signal into an output stereo signal suitable for frequency mismatched speakers of a portable electronic device, the module comprising an impulse emphasis block for emphasising impulsive sounds in the output stereo signal.

The filter block may be configured such that one channel of the output stereo signal comprises a combined low frequency signal, the combined low frequency signal corresponding to components of both channels of input stereo data below a cut-off frequency.

Some embodiments relate to an electronic device comprising: a first loudspeaker having a first power and frequency range; a second loudspeaker having a second power and frequency range which is different to the first power and frequency range; a signal processing module configure to receive an input stereo audio signal and generate output stereo data for said first and second loudspeakers; wherein the signal processing module is configured to emphasise impulsive sounds present in the input stereo data in said output stereo data.

Some embodiments relate to a signal processing module configured to receive first and second channels of stereo input audio data and generate first and second channels of output audio data for first and second loudspeakers where the first and second loudspeakers have different frequency responses to one another, wherein the signal processing module comprises a filter block operable in first and second modes, wherein: in the first mode: the first channel of output audio data comprises a combined low frequency signal and a first high frequency signal, the combined low frequency signal corresponding to audio components of both the first and second channels of stereo input audio data below a first cut-off frequency and the first high frequency signal corresponding to audio components of the first channel of stereo input audio data above a second cut-off frequency; and the second channel of output audio data comprises a second high frequency signal, the second high frequency signal corresponding to audio components of the second channel of stereo input audio data above a second cut-off frequency; and in the second mode: the first channel of output audio data comprises the combined low frequency signal; and the second channel of output audio data comprises a combined high frequency signal, the combined high frequency signal corresponding to audio components of both the first and second channels of stereo input audio data above a third cut-off frequency.

Some embodiments relate to an electronic device comprising: first and second loudspeakers; the first loudspeaker having a higher power rating and a greater response at lower frequencies than the second loudspeaker; a switching amplifier for driving said first loudspeaker; and a signal processing module configure to receive an input audio signal and generate first and second output audio channels for said first and second loudspeakers respectively; wherein the signal processing module is operable in a first mode and a second mode, wherein in the second mode the first output audio channel is limited so as to only comprise components of the input audio data below a cut-off frequency and in the first mode the first output audio channel may comprise at least some components of the input audio data above the cut-off frequency; and wherein a switching frequency of the switching amplifier is greater in the first mode than in the second mode.

The signal processing module of embodiments of the present invention may be implemented at least partly by dedicated circuitry. In some embodiments however at least some of the functionality of the signal processing modules may be implemented by suitable code running on one or more processors, which may comprise a dedicated DSP and/or may a comprise a general purpose processor that may also be performing other functions, e.g. a DSP on an audio codec or an apps processor.

The skilled person will thus recognise that some aspects of the above-described apparatus and methods, for example the calculations performed by the processor may be embodied as processor control code, for example on a non-volatile carrier medium such as a disk, CD- or DVD-ROM, programmed memory such as read only memory (Firmware), or on a data carrier such as an optical or electrical signal carrier. For many applications embodiments of the invention will be implemented on a DSP (Digital Signal Processor), ASIC (Application Specific Integrated Circuit) or FPGA (Field Programmable Gate Array). Thus the code may comprise conventional program code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware Embodiments of the invention may be arranged as part of an audio processing circuit, for instance an audio circuit which may be provided in a host device. A circuit according to an embodiment of the present invention may be implemented as an integrated circuit. One or more loudspeakers may be connected to the integrated circuit in use.

Embodiments may be implemented in a host device, especially a portable and/or battery powered host device such as a mobile telephone, an audio player, a video player, a PDA, a mobile computing platform such as a laptop computer or tablet and/or a games device for example. Embodiments of the invention may also be implemented wholly or partially in accessories attachable to a host device, for example in active speakers or headsets or the like.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single feature or other unit may fulfil the functions of several units recited in the claims. Any reference numerals or labels in the claims shall not be construed so as to limit their scope. Terms such as amplify or gain include possibly applying a scaling factor of less than unity to a signal.

The invention claimed is:

1. An electronic device comprising:

first and second loudspeakers;

the first loudspeaker having a higher power rating and a greater response at lower frequencies than the second loudspeaker;

a switching amplifier for driving said first loudspeaker; and a signal processing module configured to receive an input audio signal and generate first and second output audio channels for said first and second loudspeakers respectively;

wherein the signal processing module is operable in a first mode and a second mode, wherein in the second mode the first output audio channel is limited so as to only comprise components of the input audio data below a filter cut-off frequency and in the first mode the first output audio channel may comprise at least some components of the input audio data above the cut-off frequency; and wherein a switching frequency of the switching amplifier is greater in the first mode than in the second mode.

2. An electronic device as claimed in claim 1, wherein the signal processing module is configured to:

receive the input audio signal comprising left and right channels of stereo input audio data;

generate the first output audio channel as the sum of (a) a first high frequency signal containing components of one of the left and right channels of stereo input audio data above a separation cut-off frequency, and (b) a combined low frequency signal containing components of the left and right channels of stereo input audio data below the separation cut-off frequency; and generate the second output audio channel as a second high frequency signal containing components of the other one of the left and right channels of stereo input audio data above the separation cut-off frequency.

3. An electronic device as claimed in claim 2, comprising a controllable low pass filter in the signal path for the first high frequency signal, the controllable low pass filter being selectively operable in the first mode of operation to apply no filtering and being operable in the second mode of operation to filter the first high frequency signal to only have components below said filter cut-off frequency, the filter cut-off frequency being higher than the separation cut-off frequency.

4. An electronic device as claimed in claim 1, wherein the signal processing module is operable in the first mode or the second mode in response to a mode control signal.

5. An electronic device as claimed in claim 1, wherein the signal processing module comprises an impulse emphasis block configured to emphasise impulsive sounds in the received audio in at least one of the first and second output audio channels.

6. An electronic device as claimed in claim 5, wherein the impulse emphasis block is configured to emphasise impulsive sounds in both said first and second output audio channels.

7. An electronic device as claimed in claim 5, wherein the impulse emphasis block comprises an impulse detection function and an impulse enhancement function that is configured to enhance the effect of impulsive sounds.

8. An electronic device as claimed in claim 5, wherein the impulse emphasis block comprises a limiter having an attack time that is configured to generate distortion during audio peaks.

9. An electronic device as claimed in claim 1, wherein the signal processing module comprises a delay block configured to delay one of the first and second output audio channels with respect to the other.

10. An electronic device as claimed in claim 1, wherein the first and second loudspeakers are physically separated by less than 15 cm.

11. An electronic device as claimed in claim 1, wherein the electronic device comprises a mobile communications device.

12. An electronic device as claimed in claim 10, wherein the mobile communications device is a mobile telephone.

13. An electronic device as claimed in claim 12, wherein the first loudspeaker is a loudspeaker of the device used for media playback.

14. An electronic device as claimed in claim 12, wherein the second loudspeaker is a loudspeaker of the device used for audio output during telephone calls.

15. An electronic device as claimed in claim 1, further comprising:

at least one processor, wherein at least a portion of the signal processing module is implemented by code running on said processor.

16. A method of operation of an electronic device, wherein the electronic device comprises first and second loudspeakers and a switching amplifier for driving said first loudspeaker, wherein the first loudspeaker has a higher power rating and a greater response at lower frequencies than the second loudspeaker;

the method comprising:

receiving an input audio signal and generating first and second output audio channels for said first and second loudspeakers respectively; and allowing selection between a first mode or a second mode, wherein in the second mode the first output audio channel is limited so as to only comprise components of the input audio data below a filter cut-off frequency and in the first mode the first output audio channel may comprise at least some components of the input audio data above the cut-off frequency; and wherein a switching frequency of the switching amplifier is greater in the first mode than in the second mode.

17. A non-transitory computer readable storage medium having computer-executable instructions stored thereon that, when executed by a processor, cause the processor to perform a method according to claim 16.

* * * * *